US006647756B2

(12) United States Patent
Nieschulz

(10) Patent No.: US 6,647,756 B2
(45) Date of Patent: Nov. 18, 2003

(54) DRAW DIE SHOES

(75) Inventor: Daniel F Nieschulz, Macomb, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 5 days.

(21) Appl. No.: 10/117,402

(22) Filed: Apr. 4, 2002

(65) Prior Publication Data

US 2003/0188562 A1 Oct. 9, 2003

(51) Int. Cl.[7] ..... B21D 24/08
(52) U.S. Cl. ..... 72/350; 72/456
(58) Field of Search ..... 72/350, 351, 453.13, 72/456; 267/119, 130

(56) References Cited

U.S. PATENT DOCUMENTS 4,483,173 A * 11/1984 Duhamel ..... 72/351
5,184,496 A * 2/1993 Namba et al. ..... 72/350

* cited by examiner

*Primary Examiner*—Lowell A. Larson
(74) *Attorney, Agent, or Firm*—Marc J. Luddy

(57) ABSTRACT

An apparatus for stamping sheet metal is disclosed. The apparatus has a lower bolster having a number of air pins disposed at predetermined locations. A first die set having first and second die shoes and a stamping ring and cap are disposed on the lower bolster. The first and second die shoes are matable to form a stamped component. The second die shoe is coupled to the lower bolster so that at least one air pin is operable to apply force to the ring. The system further has third and fourth die shoes which are used to form a second stamped component. The third and fourth die shoes further have a second stamping ring and second cap. The system is such that the third and fourth die shoes can be inserted into the press after the first and second die shoes have been removed. It is not necessary to remove the air pins disposed in the lower bolster to change the die shoes.

14 Claims, 3 Drawing Sheets

DRAW DIE SHOES

FIELD OF THE INVENTION

The present invention relates generally to metal stamping systems and, more particularly, to a method and system for locating die location pins with incorporated through air pins.

BACKGROUND OF THE INVENTION

Metal stamping systems traditionally consist of shearing and forming assemblies. These assemblies are formed by an upper adapter and lower shoe. Sheet material to be formed is placed between the lower shoe and the upper adapter. The forming assembly is then brought together by use of a press to form the stamped metal component.

Referring generally to FIG. 1 which represents a prior art stamping system, disposed on the lower shoe is a ring which traps and holds the sheet stock between the upper adapter and lower shoe. Incorporated through the lower shoe and into the ring are a series of air pins which apply forces from air shocks to the ring to hold the stamped component into place. Additionally, a series of guide pins are located in a lower shoe, which support and control the movement of the ring. Traditionally, the locations of the guide pins and air pins are custom and dictated by the stamped component geometry. When a new component is to be produced in the stamping machine, the old tooling must be removed from the stamping machine. As the location of the guide pins and air pins are traditionally custom, each tool change requires a significant additional amount of time caused by the relocation of these components within the lower bolster. As such, it would be desirable to have a metal stamping system, which has a configuration, that will allow for the changing of die shoes in a minimal amount of time.

SUMMARY OF THE INVENTION

The invention includes an apparatus for stamping sheet metal components having a lower bolster supporting a plurality of air pins. The air pins are located on the bolster in a predetermined configuration. The apparatus further has a lower shoe having a cap and a ring disposed about the cap. A plurality of air pins are disposed through the lower shoe and into the ring. An upper adapter is configured to mate with the lower shoe to deform a piece of metal. The apparatus further has a second set of die components in the form of a second lower shoe and a second upper adapter. The second lower shoe is configured to accept a second ring and cap. The second lower shoe is configured to be accepted into the lower bolster without removal of the air pins.

The clamping apparatus may further include a plurality of guide pins disposed through the lower bolster and shoe to align the ring. The air pins may be encapsulated within the guide pins to prevent interference between the air pins and certain portions of the die mechanism.

Further, the stamping mechanism may have a riser disposed beneath the cap. The riser may define a plurality of spaces formed so as to prevent interference between the air pins and the riser.

The invention further includes an apparatus for forming sheet metal which includes a die assembly having first and second die shoes. The first die shoe is adapted to slidably fit within the forming assembly. The forming assembly is disposed within a lower bolster. The lower bolster has a plurality of air pins disposed on a first surface in a predetermined pattern. The second and third die shoes being operable to be accepted by the air pins upon removal of the first and second die shoes.

The invention further includes a method of replacing a first stamping tool set with a second stamping tool set when the first tool set and second tool set form substantially different components.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
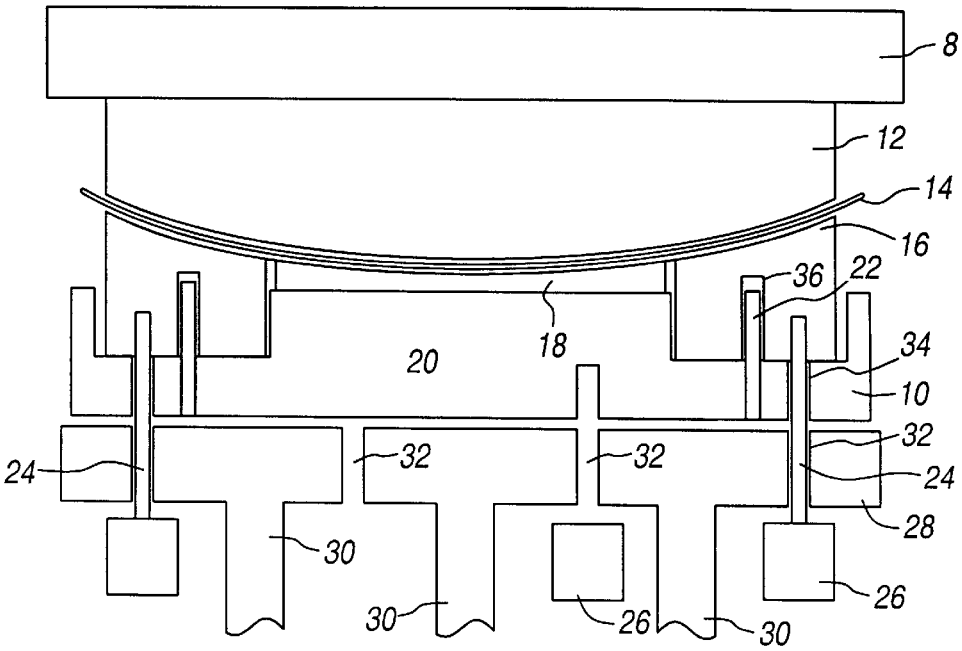
FIG.- 1 (PRIOR ART)
FIG. 1 side cross sectional view of a prior air system.
Figure 2:
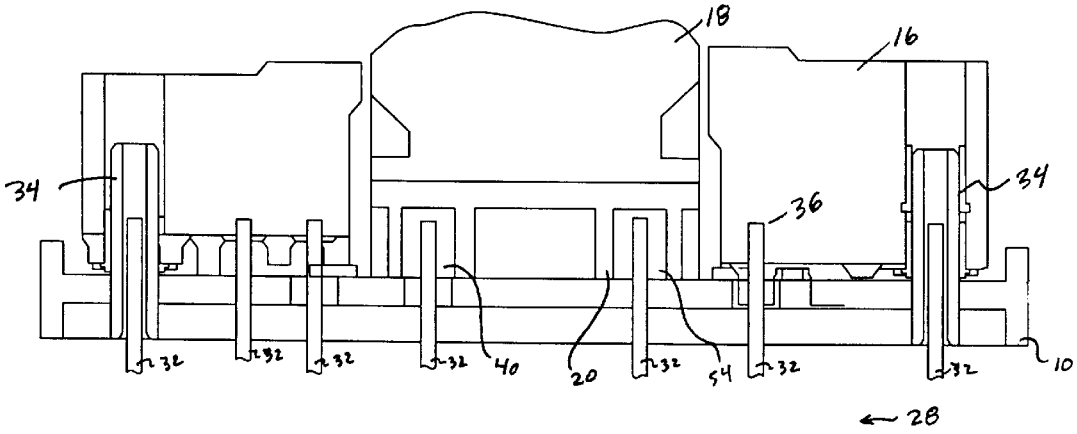
FIG. 2 is side cross sectional view of the stamping apparatus according to one embodiment of the present invention.
Figure 3:
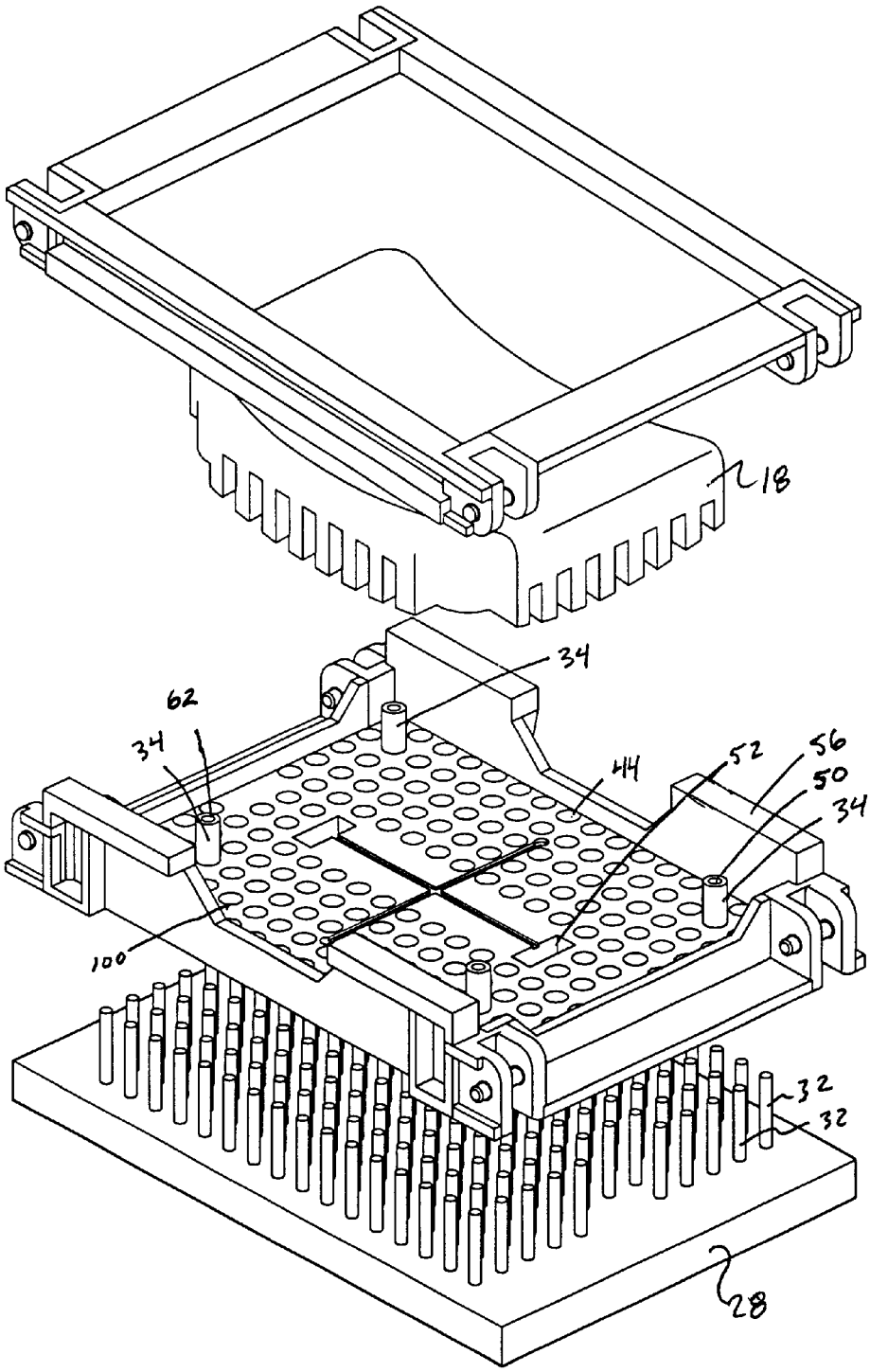
FIG. 3 is an exploded perspective view of an embodiment of the present invention.
Figure 4:
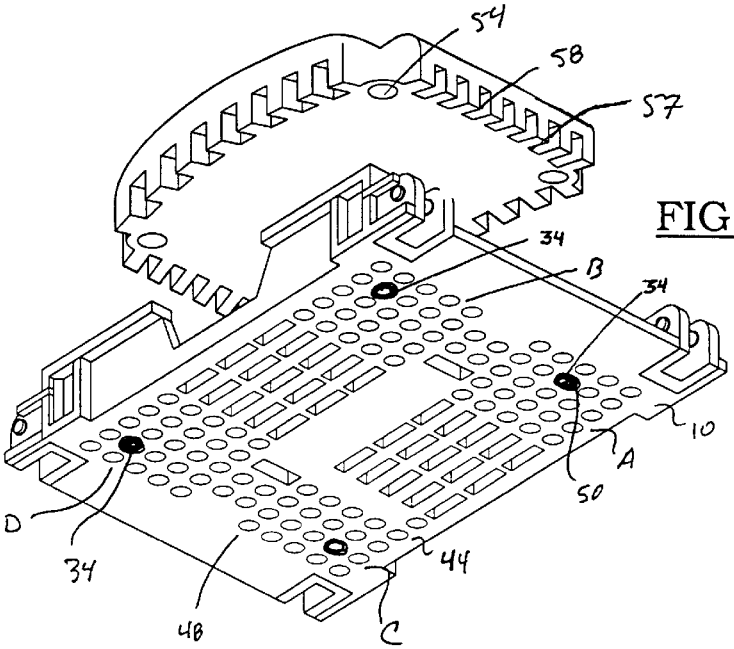
FIG. 4 is a perspective lower view of the lower shoe according to the teachings of the present invention.

Referring to the figures and, more particularly, to the FIGS. 2–4 which represent components of the systems for forming sheet metal according to the first embodiment of the invention. Depicted are a lower shoe 10, upper adapter 12, which are used to form sheet metal 14. The lower shoe 10 has a ring 16 and a cap 18. The cap 18 is disposed over a riser 20. Further shown is a lower bolster 28, which supports lower shoe 10 having a plurality of trusses 30, which support the lower bolster 28. Disposed within the lower bolster 28 is a plurality of air pins 32.

The ring or holding mechanism 16 is configured to surround the cap 18 to hold the sheet metal 14 into place within the die. The air pins 32 are configured to be slidably accepted through the lower shoe 10 to apply forces from air springs (not shown) to the ring 16 to entrap the sheet metal 14. Further shown are a plurality of guide pins 34 which function to allow proper orientation of the ring 16 with respect to the cap 18 and lower shoe 10. The air pins 32 are shown distributed at regular intervals throughout the lower shoe.

As can be seen, the guide pins 34 are configured to slidably receive the air pins 32, at locations where the air pins 32 are not going to be transmitting forces to the ring 16. The use of the guide pins 34 which accept the air pins 32 allows for the system to accommodate for air pins 32. This makes it possible to create a stamping system which does, not require the movement of the air pins 32. In other locations 36, the air pins are shown such that they engage the lower surface 38 of the ring 16.

Further shown are a plurality of cavities 40 defined in the riser 20. The cavities 40 allow for movement of the air pins 32 without importing forces from the air pins 32 into the cap 18. This also allows for fast changes to the tooling setup without removal or reconfiguration of the air pins 32.

The use of a multiple tool set having lower shoes which are configured to interface with a fixed configuration of air pins 32 allows for very quick tool changeover without the pulling or adding of air pins 32. The stamping system of the present invention utilizes a single lower bolster 28 having air pins 32 with a fixed configuration, for example, and array of fixed spaced pins. The array of air pins 32 are used for each of the multiple tool sets.

FIG. 3 represents a partial top view of the lower shoe of FIG. 2. As can be seen, an array of air pins 32 are disposed within the surface 42 of the lower bolster 28. Also shown is the guide pin 34 which slidably accepts the air pin 32 through a through bore 62. Should component design dictate, a guide pin can be placed over any of the air pins 32 to change distribution of forces to the ring 16.

FIGS. 3 and 4 represent a lower perspective view of the lower shoe 10 of the first embodiment of the present invention. Disposed within the first surface 44 of the lower shoe 10 is an array of 50 mm holes 48. The holes 48 slidably accept the air pins (not shown). Further shown are four guide pins 34. The guide pins 34 define through bores 50 which slidably accept the air pins 32. The guide pins 34 function to control the movement of the ring 16. Additionally defined within the top surface 100 of the lower shoe 10 is built-in die locators 52. Fastened to the top surface 100 of the lower shoe 10 is the cap 18. Defined within the top surface of the cap 18 is a plurality of recesses 54. Each recess 54 gives a place to position the head of a standard fastener (not shown) which is used to couple the cap 18 to the lower shoe 20, 10. Additionally shown are other features such as the variable safety pad and stop block area 56.

As can be seen, lower shoe 10 is defined into four quadrants A–D. Each quadrant A–D defines regions with increased thicknesses, which can accept a press fit guide pin 34 to slidably support ring 16. Regions not defined by quadrants A–D are of lower thickness to reduce weight and material costs.

Additionally shown is the underside 57 of cap 18. Defined on the underside 57 of cap 18 is a plurality of recesses 58 which function to allow air pins 32 to not interact with the cap 18. Optionally, a spacer (not shown) can be positioned between the cap 18 and the lower shoe 10. Preferably, the space would have recesses 58 defined therein to prevent interaction with the air pins 32.

The apparatus for stamping sheet metal according to the teachings of the present invention utililizes single a lower bolster 28 having a plurality of air pins 32 disposed in predetermined locations. A pair of die sets, each configured to produce components have substantially different shapes, are matable to the lower bolster 28 without changing the location of the air pins 32. A first die set has a first upper adapter 12 and a first lower die shoe 10, a ring 16, and a cap 18. The first upper adapter 12 and first die shoe 10 are matable to form a first stamped component, while the said first lower die shoe 10 is matable with the air pins 32 so that at least one air pin 32 is operable to apply forces to the ring 16. In situations where another component must be produced, a second die set having a second upper adapter 12' and second lower die shoe 10', a second stamping ring 16', a second cap 18' is coupled to the lower bolster 28'. The second lower die shoe 10' is matable with said air pins 32 such that at least one air pin 32 is operable to apply forces to said second stamping ring 16'. It is important that the lower shoes 10 and 10' and rings 16 and 16' from each die set be configured so that no air pins 32 must be removed in order for an operator to change die sets.

Figure 5:
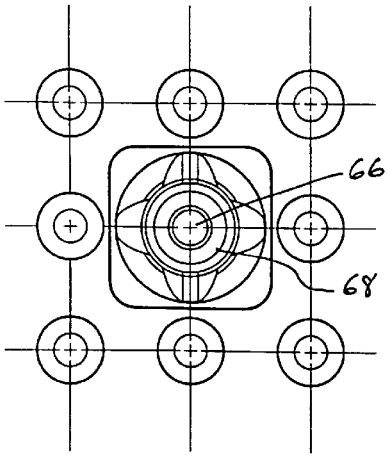
FIG. 5 represents a top view of the lower shoe shown in FIG. 4 according to the teachings of the present invention.
Figure 6:
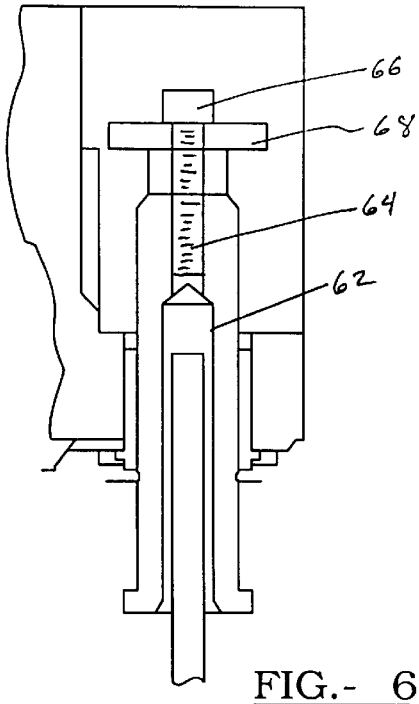
FIG. 6 is a cross sectional side view of the lower shoe according to a second embodiment of the present invention.

FIGS. 5 and 6 represent side views of a second embodiment of the present invention. Shown is an alternate guide pin assembly 60 for use with a die set, which defines a first air pin accepting bore 62. Additionally, the guide pin 58 defines a second threaded bore 64 which is capable of accepting a threaded bolt 66. The threaded bolt 66 functions to hold a retainer cap 68. The retainer cap 68 is an additional safety feature to assist in the retention of the die ring 16 to the lower shoe 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for stamping sheet metal comprising:

a lower bolster having a plurality of air pins disposed in predetermined locations;

a first die set having a first upper adapter, a first die shoe, a first stamping ring, and a first cap, where said first upper adapter is positioned on said sheet metal and said first die shoe, said first stamping ring, and said first cap are positioned on said sheet metal on a side opposing said first upper adapter for forming a first stamped component, said first die shoe being matable with said plurality of air pins so that at least one of said plurality of air pins is operable to apply force to said first stamping ring; and a second die set having a second upper adapter, second die shoe, second stamping ring, and a second cap, where said second upper adapter is positioned on said sheet metal and said second die shoe, said second stamping ring, and said second cap are positioned on said sheet metal on a side opposing said second upper adapter for forming a second stamped component having a shape substantially different from said first stamped component, said second die shoe being matable with said plurality of air pins such that at least one of said plurality of air pins is operable to apply force to said second stamping ring; and further comprising at least one guide pin disposed partially within a bore defined in said first die shoe, or said second die shoe, or both said first die shoe and said second die shoe where said guide pin is slidably accepted within said first stamping ring or said second stamping ring or both said first stamping ring and said said second stamping ring, and where said at least one guide pin defines a bore configured to accept one of said plurality of air pins.

2. The system of claim 1, further comprising a spacer disposed between said first shoe and said first cap, or between said second shoe and said second cap, or between both said first shoe and said first cap and said second shoe and said second cap.

3. The system of claim 2 wherein said spacer defines a plurality of compartments each operable to accept one of said plurality of air pins and prevent operative contact between said one of said plurality of air pins and said spacer.

4. The apparatus of claim 1 wherein said at least one guide pin further comprises a retainer cap.

5. The apparatus of claim 1 where said plurality of air pins are spaced apart from each other at about regular intervals.

6. The apparatus of claim 1 where said second die shoe is configured to mate with said lower bolster without removing any of said plurality of air pins.

7. An apparatus for stamping sheet metal comprising:

a lower bolster having a plurality of air pins disposed in predetermined locations; and a first die set having a first die shoe and a first holding mechanism, where said first die shoe mates with at least one of said plurality of air pins such that at least one of said plurality of air pins operates to apply force to said holding mechanism, said first die shoe further having at least one guide pin, where said at least one guide pin defines a bore operable to accept one of said plurality of air pins.

8. The apparatus of claim 7 further comprising a second die set having a second die shoe and second holding member, said second die shoe further comprising a second guide pin operable to slidably accept one of said plurality of air pins.

9. The apparatus for stamping sheet metal according to claim 8, where said first die set further comprises a first upper adapter, where said first upper adapter and said first die shoe mate to form a first stamped component, where said second die set comprises a second upper adapter, and where said second upper adapter and said second die shoe mate to form a second stamped component having a shape substantially different from said first stamped component.

10. The apparatus for stamping sheet metal according to claim 8, where said first holding mechanism is a first ring, or said second holding mechanism is a second ring, or said first holding mechanism is a first ring and said second holding mechanism is a second ring.

11. The apparatus of claim 8, where said first guide pin comprises a first locking cap, or said second guide pin comprises a second locking cap, or said first guide pin comprises a first locking cap and said second guide pin comprises a second locking cap.

12. The apparatus of claim 8, where said first lower shoe defines a plurality of quadrants, where at least one of said plurality of quadrants has a thickness greater than another, or where said second lower shoe defines a plurality of quadrants, where at least one of said plurality of quadrants has a thickness greater than another, or where said first lower shoe and said second lower shoe each define a plurality of quadrants, where at least one of said plurality of quadrants for both said first lower shoe and said second lower shoe has a thickness greater than another.

13. The apparatus of claim 7, where said plurality of air pins are spaced apart from each other at regular intervals.

14. The apparatus according to claim 7, where at least one of said plurality of air pins is coupled to an air spring.

* * * * *